US006668937B1

(12) United States Patent
Murray

(10) Patent No.: US 6,668,937 B1
(45) Date of Patent: Dec. 30, 2003

(54) PIPE ASSEMBLY WITH A PLURALITY OF OUTLETS FOR USE IN A WELLBORE AND METHOD FOR RUNNING SUCH A PIPE ASSEMBLY

(75) Inventor: Geoffrey Neil Murray, Willis, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/869,748

(22) PCT Filed: Jan. 7, 2000

(86) PCT No.: PCT/GB00/00029

§ 371 (c)(1),
(2), (4) Date: Sep. 4, 2001

(87) PCT Pub. No.: WO00/41487

PCT Pub. Date: Jul. 20, 2000

(30) Foreign Application Priority Data

Jan. 11, 1999 (NZ) ..... 333681

(51) Int. Cl.[7] ..... E21B 21/10
(52) U.S. Cl. ..... 166/381; 166/383; 166/301
(58) Field of Search ..... 166/298, 383, 166/386, 319, 301, 306, 316, 334.4

(56) References Cited

U.S. PATENT DOCUMENTS

| | | | | | |
|---|---|---|---|---|---|
| 3,334,697 | A | | 8/1967 | Edwards et al. | 175/231 |
| 4,213,508 | A | | 7/1980 | Tschirky et al. | 175/235 |
| 4,361,193 | A | | 11/1982 | Gravley | 175/61 |
| 4,605,074 | A | | 8/1986 | Barfield | 175/4.52 |
| 4,676,306 | A | * | 6/1987 | Russell | 166/319 |
| 4,790,384 | A | * | 12/1988 | Schellstede et al. | 166/298 |
| 5,392,851 | A | | 2/1995 | Arend | 166/65.1 |
| 5,392,862 | A | * | 2/1995 | Swearingen | 166/386 |
| 5,411,049 | A | | 5/1995 | Colvard | 137/71 |
| 5,641,021 | A | | 6/1997 | Murray et al. | 166/291 |
| 6,343,657 | B1 | * | 2/2002 | Baugh et al. | 166/383 |

OTHER PUBLICATIONS

PCT Search Report for PCT/GB00/00029, dated Aug. 14, 2000.

* cited by examiner

*Primary Examiner*—Frank S. Tsay
(74) *Attorney, Agent, or Firm*—Moser, Patterson & Sheridan, L.L.P.

(57) ABSTRACT

A pipe assembly (5) for use in a wellbore (3) having a plurality of outlets (6) positioned about the periphery of the pipe at longitudinally spaced apart intervals for allowing fluid to pass from the interior to the exterior of the pipe.

13 Claims, 1 Drawing Sheet

PIPE ASSEMBLY WITH A PLURALITY OF OUTLETS FOR USE IN A WELLBORE AND METHOD FOR RUNNING SUCH A PIPE ASSEMBLY

The present invention relates to a pipe assembly incorporating means for lubricating a section of pipe as it is run into a well bore. The pipe may be casing liner, drillpipe, tubing or coil tubing. The invention also relates to a method of running in a section of pipe.

When a section of casing is run into a well it is common to employ lubricants to reduce the friction between the outer wall of the casing and the wall of the well. Typically, lubricants are pumped between the outer wall of the casing and the wall of the well. Such lubricants effectively provide only static lubrication. Once the casing is moving relative to the well the lubricants can provide effective lubrication. However, when movement is first initiated the lubricants may not provide effective lubrication and the starting torque to initiate movement of the casing string may be greater than the limits of the rig or the casing connections.

According to a first aspect of the invention, there is provided a pipe assembly for use in a wellbore having a plurality of outlets positioned about the periphery of the pipe at longitudinally spaced apart intervals for allowing fluid to pass from the interior to the exterior of the pipe, characterised in that a non-return valve is provided in each outlet, activated by a fusible link, which prevents flow from the interior of the pipe out of the outlets when activated. The fusible link may be actuated by an acid or alkaline pill.

The outlets may have fluid communication passages between the interior of the pipe and orifices of the outlets to convey fluid from within the pipe to the outlet orifices.

The pipe may be casing, liner, drill pipe, tubing or coil tubing. The outlets preferably include one way valves to ensure that fluid may only flow from the interior of the pipe out of the outlets and not in the return direction.

The outlets may preferably be provided on sub-sections joining sections of pipe. The outlets may include flexible seals provided about the outlet orifices.

There is further provided a method of running a section of pipe in a well bore comprising running a pipe assembly having outlets positioned about the periphery of the pipe at spaced apart intervals in the weelbore, and supplying lubricating fluid to the interior of the pipe at a sufficient pressure to cause lubricating fluid to exit from the outlets so as to provide effective hydrodynamic friction reduction between the pipe assembly and the wall of the well.

Preferably the pipe assembly includes a non-return valve that is actuated by a fusible link and after the casing is run and acid or alkaline pill is introduced into the interior of the pipe assembly to break the fusible link to actuate the non-return valve to prevent fluid flowing through the outlets.

A preferred embodiment of the invention will now be described by way of example only and with reference to the accompanying drawings in which.

Figure 1:
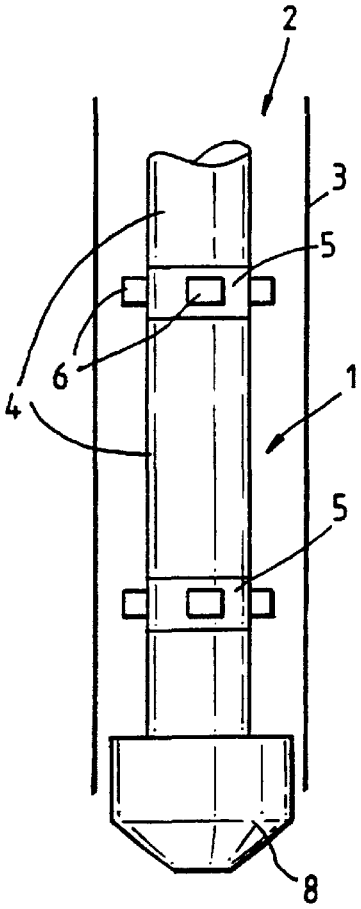
FIG. 1 shows a schematic diagram of a casing assembly incorporating friction reduction means.
Figure 2:
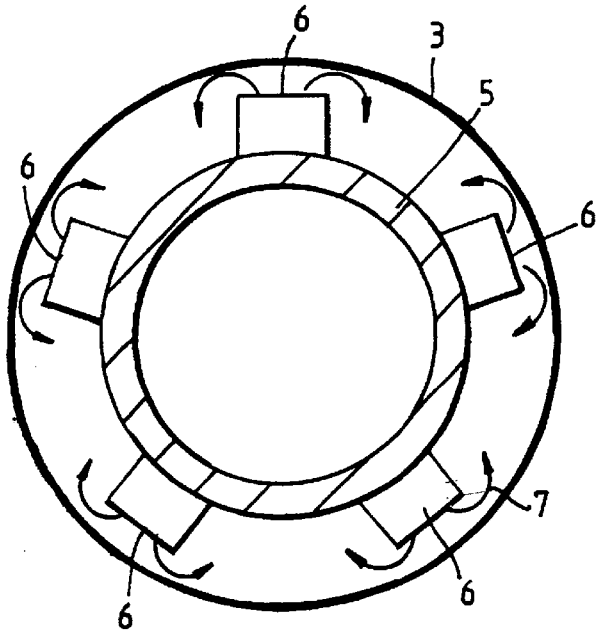
FIG. 2 shows a cross-sectional view through a section of the casing assembly shown in FIG. 1.

Referring to FIGS. 1 and 2 a casing assembly 1 is shown within a well 2 having a wall 3. The casing assembly 1 consists of casing sections 4 joined together by sub-sections 5. A plurality of outlets 6 are provided about the periphery of sub-sections 5 which expel lubricating fluid supplied under pressure via the interior of sections 4 and 5. A float shoe 8 is shown connected to the bottom of the casing assembly 1.

Figure 3:
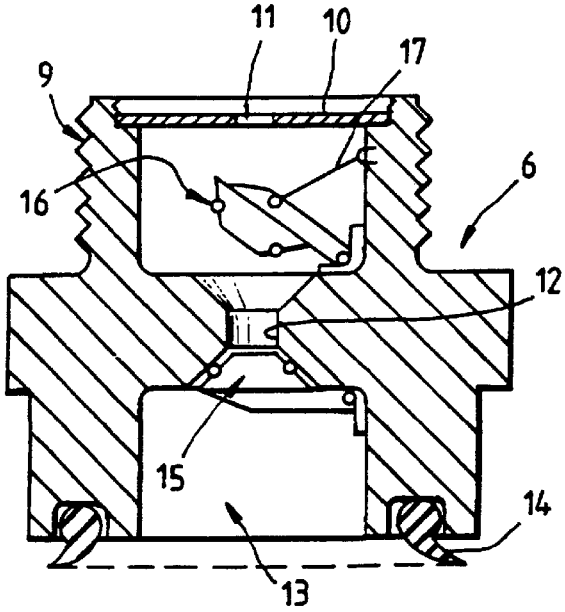
FIG. 3 shows a cross-sectional view of an outlet of the casing assembly shown in FIGS. 1 and 2.

Referring now to FIG. 3 an outlet 6 is shown in greater detail. The outlet has a threaded end 9 which screws into a corresponding threaded bore within a respective sub-section 5. Plate 10 has an aperture 11 therein to control the fluid supplied to an outlet 6. The apertures 11 may be differently sized at different depths to achieve the desired fluid distribution along the length of the casing assembly.

Fluid from the interior of sub-section 5 may flow through aperture 11 through passage 12 and out via orifice 13. A flexible seal 14 may be provided about orifice 13 to assist in assuring hydrodynamic lubrication between the orifice and the well wall 3.

Non-return valve 15 ensures that fluid can only flow in a direction from aperture 11 to orifice 13 and not in the return direction. Non-return valve 16 is retained in a normally open position by a fusible link 17. Fusible link 17 may be broken by an acid or alkaline pill to cause the valve to close and prevent fluid flow in the direction from aperture 11 to orifice 13.

In use, float shoe 8 is initially closed and the casing assembly 1 is run down well bore 4. During this operation lubricating fluid is supplied to the interior of casing section 4 and sub-section 5 under pressure. Lubricating fluid from sub-sections 5 flows out through outlet 6 to create hydrodynamic lubrication between the casing assembly and the wall 3 of well 2. This greatly reduces friction between the casing assembly 1 and the wall 3 of well 2 both during start-up and as the casing assembly 1 is run into position. This reduces the load on connections between sections of casing as well as the power of the rig required to run the casing.

Once the casing has been run to a desired position an acid or alkaline pill is introduced into the lubricating fluid to be conveyed to the outlets 6. The alkaline or acid environment causes the links 7 to break, causing valves 16 to close due to the action or fluid pressure or under biasing from a biasing means.

The float shoe 8 is then opened. This is typically achieved by sending a steel ball through the inside of casing assembly 1 to impact and open float shoe 8. Thus material pumped down casing 1 may exit via the float shoe only and not via outlet 6.

The casing assembly 1 is then cleaned and cement is then pumped down the casing under pressure which forces up to fill the spaces between casing assembly 1 and the wall 3 of the well 2. The cement is followed by a drillable plug, formed of a material such as phenolic, aluminium or gun metal. The plug is forced to the bottom of the casing assembly to force the cement out of the casing assembly 1. The plug may subsequently be drilled when the next stage of drilling is carried out.

To ensure that fluid is supplied to the locations most requiring lubrication outlets 6 may include gravity valves so that fluid is supplied when the casing assembly 1 is substantially upright or the outlet is on the downward side of the casing assembly 1 (when running along a lateral) but not when the outlet is on the upper side of the casing assembly 1 (when running along a lateral). This ensures that lubricating fluid is supplied only to those outlets resting against the wall of the well.

Although the invention has been described in relation to an embodiment in which sections of casing 4 are interconnected via subsections 5, it is to be appreciated that outlets could be provided directly from casing sections 4. The use of sub-sections 5 is preferred as this enables standard casing to be used without modification.

It will also be appreciated that the invention may be applied to liner, drill pipe, or coil tubing with obvious modifications.

Where in the foregoing description reference has been made to integers or components having known equivalents then such equivalents are herein incorporated as if individually set forth.

Although this invention has been described by way of example it is to be appreciated that improvements and/or modifications may be made thereto without departing from the scope of the present invention.

What is claimed is:

1. A pipe assembly (1) for use in a wellbore (2) having a plurality of outlets (6) positioned about the periphery of the pipe at longitudinally spaced apart intervals for allowing fluid to pass from the interior to the exterior of the pipe, characterized in that each outlet comprises a non-return valve (16) activatable by a fusible link (17) which prevents fluid flow from the interior to the exterior of the pipe when activated.

2. A pipe assembly as claimed in claim 1, wherein the fusible link (17) is actuated by the action of an acid or alkaline pill.

3. A pipe assembly as claimed in claim 1, comprising fluid communication passages between the interior of the pipe and one or more external orifices of the outlets to convey fluid from within the pipe to the external orifices.

4. A pipe assembly as claimed in claim 1, wherein the outlets comprise one way valves arranged such that fluid may only flow from the interior to the exterior of the pipe.

5. A pipe assembly as claimed in claim 1, wherein the outlets are provided on sub-sections joining sections of pipe.

6. A pipe assembly as claimed in claim 1, wherein the outlets include flexible seals provided around one or more external orifices.

7. A pipe assembly as claimed in claim 1, wherein the pipe assembly is a casing assembly.

8. A method of running a pipe in a wellbore comprising:

running a the pipe with an assembly having outlets positioned around the periphery of the pipe at spaced apart intervals in the wellbore; and supplying lubricating fluid to the interior of the pipe at sufficient pressure to cause the lubricating fluid to exit from the outlets so as to provide hydrodynamic friction reduction between the pipe assembly and the wall of the wellbore.

9. A method as claimed in claim 8, wherein the outlets have a non-return valve actuated by a fusible link, and further comprising introducing an acid or alkaline pill into the interior of the pipe assembly after the pipe assembly is run, the acid or alkaline pill breaking the fusible link and thereby actuating the non-return valve to prevent fluid flowing through the outlets.

10. A pipe assembly for use in a wellbore having one or more outlets positioned about a periphery of a pipe for allowing fluid to pass from an interior to an exterior of the pipe, characterized in that each outlet comprises a non-return valve activatable by a fusible link which prevents fluid flow from the interior to the exterior of the pipe when activated.

11. A method of running a pipe in a wellbore comprising:

running the pipe with an assembly having one or more outlets positioned through a periphery of the pipe; and supplying fluid to an interior of the pipe at sufficient pressure to cause the fluid to exit from the one or more outlets so as to provide friction reduction between the pipe and a wall of the wellbore.

12. The method of claim 11, wherein the one or more outlets have a non-return valve actuated by a fusible link.

13. The method of claim 12, further comprising introducing an acid or alkaline pill into the interior of the pipe after the pipe is run, the acid or alkaline pill breaking the fusible link and thereby actuating the non-return valve to prevent fluid flowing through the one or more outlets.

* * * * *